US010654264B2

(12) United States Patent
Tanaka et al.

(10) Patent No.: US 10,654,264 B2
(45) **Date of Patent: *May 19, 2020**

(54) PRINTING SYSTEM, PRINTING CONTROL APPARATUS, AND PRINTING CONTROL METHOD

(71) Applicant: CANON FINETECH NISCA INC., Misato-shi (JP)

(72) Inventors: Yusuke Tanaka, Misato (JP); Daichi Nitta, Misato (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/172,902

(22) Filed: Oct. 29, 2018

(65) Prior Publication Data

US 2019/0126615 A1 May 2, 2019

(30) Foreign Application Priority Data

Oct. 30, 2017 (JP) ..... 2017-209645
Oct. 19, 2018 (JP) ..... 2018-197837

(51) Int. Cl.
*B41J 2/045* (2006.01)
*B41J 11/00* (2006.01)
(Continued)

(52) U.S. Cl.
CPC ..... *B41J 2/04568* (2013.01); *B41J 2/04541* (2013.01); *B41J 2/04596* (2013.01);
(Continued)

(58) Field of Classification Search
CPC .. B41J 2/04536; B41J 2/04541; B41J 2/2135; B41J 2/2146; B41J 2/04568; B41J 2/04596; B41J 11/007; B41J 13/0027
See application file for complete search history.

(56) References Cited

U.S. PATENT DOCUMENTS 6,969,155 B2 * 11/2005 Umezawa ..... B41J 2/04541 347/11
10,300,694 B2 * 5/2019 Kaburagi ..... B41J 2/04573

FOREIGN PATENT DOCUMENTS

JP 2006-007635 A 1/2006
JP 2006-289859 A 10/2006

OTHER PUBLICATIONS

U.S. Appl. No. 16/172,904, Yusuke Tanaka Daichi Nitta, filed Oct. 29, 2018.

* cited by examiner

*Primary Examiner* — Thinh H Nguyen
(74) *Attorney, Agent, or Firm* — Venable LLP

(57) ABSTRACT

A printing system includes a printing apparatus and a printing control apparatus for creating image data to be printed. The printing apparatus has a print head having an array of printing elements, a conveying unit for conveying a print medium in a direction intersecting with the array direction, and a control unit for setting the conveying speed. The printing control apparatus has an acquisition unit for acquiring a maximum concurrent drive number in the printing elements based on image data, an adjustment value for adjusting an inclination of a print position of the print head with respect to the conveying direction, and a maximum value and minimum value of an adjustment value for adjusting a print position of the print head in the array direction. The control unit sets the conveying speed based on the acquired maximum concurrent drive number.

8 Claims, 17 Drawing Sheets

(51) Int. Cl.
*B41J 13/00* (2006.01)
*B41J 2/21* (2006.01)

(52) U.S. Cl.
CPC ..... *B41J 2/2135* (2013.01); *B41J 2/2146* (2013.01); *B41J 11/007* (2013.01); *B41J 13/0027* (2013.01); *B41J 2/04508* (2013.01)

| K | EJECTION NUMBER |
|---|---|
| FIRST | 0 |
| SECOND | ・・・ |
| THIRD | ・・・ |
| ・・・ | ・・・ |
| ・・・ | ・・・ |
| ・・・

PRINTING SYSTEM, PRINTING CONTROL APPARATUS, AND PRINTING CONTROL METHOD

BACKGROUND OF THE INVENTION

Field of the Invention

The present invention relates to a printing system, a printing control apparatus, and a printing control method.

Description of the Related Art

There is a printing apparatus configured to perform a printing operation during a relative scan of a print head, in which printing elements such as nozzles including ink ejection openings are arrayed, and a print medium in a direction intersecting with the direction of the ejection opening array. In this printing apparatus, the print head is driven concurrently with the relative scan. In the case of supplying power necessary for that from a common power supply, if the power supply is selected on the assumption that it can supply sufficient power even when ink is concurrently ejected from all the ejection openings of the print head and a print medium is conveyed at the maximum speed, the power supply should be a large-capacity one. However, in general, not many images require concurrent ink ejection from all the ejection openings. The use of a reduced-capacity power supply is thus considered, but in the case of a high-duty image including dots widely formed at high density, a shortage of power supply capacity may occur, which causes a void in a printed image.

To counter the above problem, in Japanese Patent Laid-Open No. 2006-289859, the number of nozzles that are concurrently driven to perform ejection operation (hereinafter referred to as "concurrent ejection number") is calculated in advance based on image data. If the number is greater than or equal to a predetermined value, a conveying speed is reduced or a print scan is divided into several scans. This countermeasure is thus premised on the calculation of the concurrent ejection number. However, in some cases, the concurrent ejection number cannot be calculated only from image data. For example, in a printing apparatus configured to perform printing by means of print heads arranged in parallel in a relative scan direction (conveying direction) of a print medium, adjustment called registration is performed for highly accurate alignment of the positions of dots formed by the print heads. The adjustment value should be taken into consideration when performing the calculation.

Registration includes adjustment between the positions of dots formed by the print heads in the print medium conveying direction (vertical adjustment) and adjustment between the positions of dots formed by the print heads in the ejection opening array direction (horizontal adjustment). In vertical adjustment, depending on a distance between a print head located upstream in the conveying direction and a print head located downstream, a timing of ink ejection by the downstream print head is adjusted. In horizontal adjustment, a print head in which ejection openings are arrayed in a range wider than the width of a print medium is used to adjust a range of ejection openings to be used for printing between print heads in accordance with position displacement between the print heads in the ejection opening array direction. In Japanese Patent Laid-Open No. 2006-7635, adjustment based on an inclination of a print head with respect to the conveying direction (inclination adjustment) is performed as registration. Since the concurrent ejection number changes depending on the adjustments, the adjustment values should be reflected in the calculation of the concurrent ejection number.

However, the installation state of the print heads including a distance between print heads in the conveying direction, position displacement between print heads in the ejection opening array direction, and an inclination of print heads with respect to the conveying direction are different for each printing apparatus. Accordingly, to reflect the adjustment values in concurrent ejection number calculation, the adjustment values set for the printing apparatus must be acquired in advance. However, in a printing system composed of a host apparatus and a printing apparatus, in the case of creating image data before the establishment of communication between the host apparatus and the printing apparatus, the concurrent ejection number cannot be calculated in advance. In this case, the host apparatus first creates only image data, then acquires the adjustment values after the establishment of communication with the printing apparatus, and calculates the concurrent ejection number. The host apparatus then transmits the calculated value to the printing apparatus together with the image data and the printing apparatus determines a conveying speed based on them and starts printing. That is, the conventional printing system has a problem that printing operation cannot be started immediately after the establishment of communication between the host apparatus and the printing apparatus.

SUMMARY OF THE INVENTION

In a first aspect of the present invention, there is provided a printing system including a printing apparatus configured to perform printing on a print medium and a printing control apparatus configured to create image data used for printing by the printing apparatus, wherein the printing apparatus has:

a print head in which a plurality of printing elements are arrayed;

a conveying unit configured to convey a print medium to a print area facing the print head in a conveying direction intersecting with an array direction of the printing elements; and a control unit configured to set a conveying speed of the conveying unit, the printing control apparatus has:

an acquisition unit configured to acquire a maximum concurrent drive number in the printing elements based on the image data, an inclination adjustment value used for adjusting an inclination of a print position of the print head with respect to the conveying direction, and a maximum value and minimum value of an array direction adjustment value used for adjusting a print position of the print head in the array direction, and the control unit of the printing apparatus sets the conveying speed of the conveying unit based on the maximum concurrent drive number acquired by the acquisition unit of the printing control apparatus and performs printing based on the image data transmitted from the printing control apparatus.

Further features of the present invention will become apparent from the following description of exemplary embodiments with reference to the attached drawings.

BRIEF DESCRIPTION OF THE DRAWINGS

FIG. 9 is an illustration of an example of an ejection number list created in the processing of FIG. 8;

DESCRIPTION OF THE EMBODIMENTS

Figure 1:
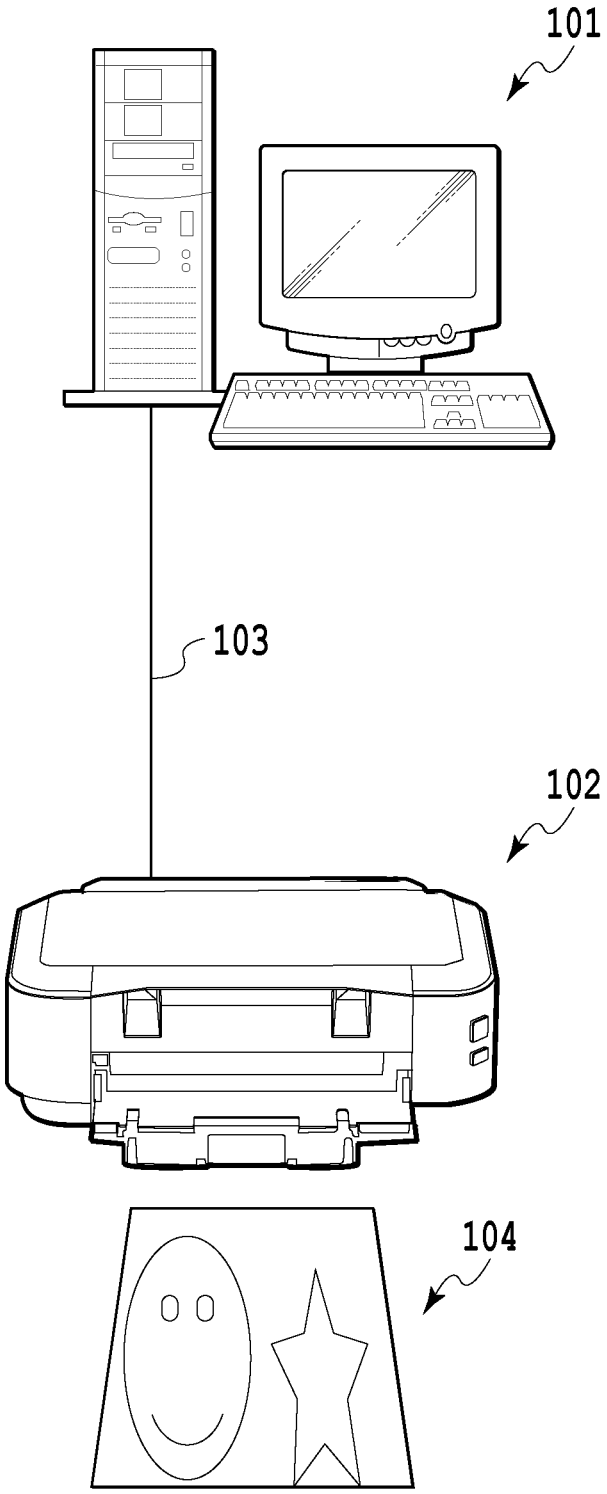
FIG. 1 is a schematic diagram showing a configuration of a printing system according to an embodiment of the present invention.

Preferred embodiments of the present invention will be described below in detail with reference to the accompanying drawings. It should be noted that the description below is not intended to limit the claims of the present invention and that not all of the combinations of the features described herein are necessarily required for the means to solve the problem to be solved by the present invention. It should also be noted that the same reference numeral is assigned to the same constituent element and the description thereof may be omitted.

In this specification, "printing" (or "image forming") does not only express formation of significant information such as characters and figures. "Print medium" widely means any medium capable of receiving ink such as a cloth, plastic film, metal plate, glass, ceramic, wood, or leather, as well as paper used in general printing apparatuses. "Ink" (or "liquid") should be broadly interpreted in the same way as the above definition of "printing." That is, the term expresses a liquid that is applied to a print medium to form an image, design, pattern or the like. "Nozzle" collectively means an ejection opening, a liquid path communicating with the ejection opening, and an element that generates energy used for ink ejection, unless otherwise specified.

1. Printing System

FIG. 1 is a schematic diagram showing a configuration of a printing system according to an embodiment of the present invention. The printing system includes a host apparatus 101 in the form of a personal computer (PC) that is a printing control apparatus configured to create print data and a printing apparatus 102 configured to perform printing under instructions from the host apparatus 101. In the present embodiment, an inkjet printing apparatus is described as an example of the printing apparatus 102. The host apparatus 101 and the printing apparatus 102 can communicate with each other via a connecting cable 103. The printing apparatus 102 performs printing on a print medium 104 such as printing paper based on print data received from the host apparatus 101. Although the shown example shows a system in which one printing apparatus 102 is connected to one host apparatus 101 via the connecting cable 103, the connection may be made via a LAN or the like and a plurality of printing apparatuses may be connected. Further, as to an aspect of the connection, either of wired communication and wireless communication may be performed.

Figure 2:
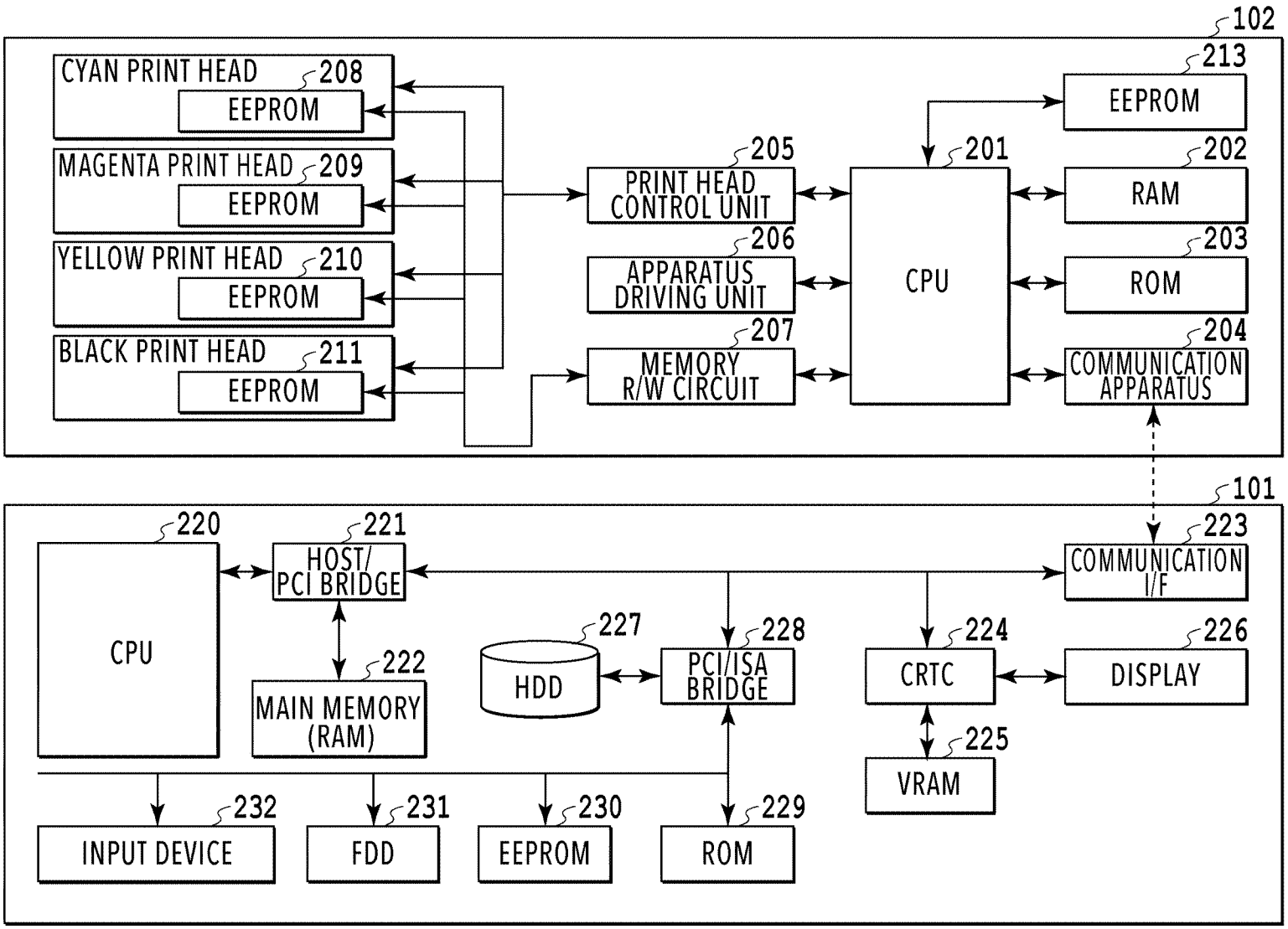
FIG. 2 is a block diagram showing a configuration example of control systems of constituent elements of the printing system.

FIG. 2 is a diagram showing a functional block configuration in each of the host apparatus 101 and the printing apparatus 102 which are constituent elements of the printing system. The host apparatus 101 has a known form such as a general personal computer. The host apparatus 101 serves as a supply source of image data used for printing by the printing apparatus 102 and is installed with a printer driver, which is a program that causes the printing apparatus 102 to perform the printing operation. A CPU 220 of the host apparatus 101 executes the printer driver, thereby transmitting image data and maximum ejection number data provided for causing the printing apparatus to perform conveyance operation control, which will be described later. The CPU 220 executes the printer driver and various programs stored in a storage area such as a RAM and implements the operation of the present embodiment under the control of an operating system (OS).

A system bus of the CPU 220 has a hierarchical bus configuration. For example, the system bus is connected to a local bus such as a PCI bus via a host/PCI bridge 221, further connected to an ISA bus via a PO/ISA bridge 228, and connected to a device on each bus. Blocks in the host apparatus 101 transmit data to and receive data from one another via the system bus. Although not shown, a high-speed memory using a static RAM (SRAM) called L2 cache can be connected to the system bus so as to store codes and data to be continuously accessed by the CPU 220.

A main memory 222 is used as a storage area for temporarily storing execution programs such as the operating system (OS), an application program, and the printer driver. The main memory 222 is also used as a working memory area for execution of each program. The main memory 222 also stores, for example, RGB image data obtained through rendering processing by an application program and ink color data obtained through color space conversion of the RGB image data and corresponding to each of ink colors of print heads of the printing apparatus 102. In the present embodiment, the ink color data is binary data corresponding to each of the ink colors: black, cyan, magenta, and yellow.

The host apparatus 101 expands, on the main memory 222, image data binarized by an error diffusion method or the like, maximum concurrent ejection number data obtained through processing to be described later, and the like. Then, the host apparatus 101 creates print data by adding the maximum ejection number data to the image data and transmits the print data to the printing apparatus 102 via a communication interface 223. The communication interface 223 is, for example, a USB interface or a network interface, and is connected to the PCI bus.

A CRTC 224 is a video controller. The CRTC 224 reads display bitmap data written to a VRAM 225 by the CPU 220 and transfers it to a display 226 such as a CRT, LCD, or PDP. The display 226 allows a user to confirm, for example, a processing progress and processing result of a print job instructed to be printed.

A ROM 229 stores a Basic Input Output System (BIOS) program for controlling input/output devices such as an input device 232 and an FDD 231, an initialization program at power-up, a self-diagnostic program, and the like. The input device 232 is, for example, a keyboard or a pointing device. For instance, a user can use the input device 232 to instruct the printing apparatus 102 to perform printing. An EEPROM 230 is a rewritable nonvolatile memory for storing various permanently-used parameters.

Programs such as the operating system (OS), various application programs, a program that executes each process, and the printer driver corresponding to the printing apparatus 102 are loaded from an HDD 227 into the main memory 222 and executed by the CPU 220. Print data created offline is stored in the HDD 227. Concurrent ejection number acquisition processing is performed at the time of print data creation to be described later.

The printing apparatus 102 includes a RAM 202 for storing print data and maximum concurrent ejection number data, a ROM 203 for storing control programs, concurrent ejection number, and the like, a communication apparatus 204 to be an interface that communicates with the host apparatus 101, and a print head control unit 205 for drive control of each print head. The printing apparatus 102 also includes an EEPROM for example, as a non-volatile memory for storing the various adjustment values also when the printing apparatus 102 is powered off. The printing apparatus 102 also includes an apparatus driving unit 206 for drive control of an actuator for print medium conveyance and the like, and a memory control circuit 207 for control of reading from and writing to (R/W) memories (EEPROMs) 208 to 211 in the respective print heads. A CPU 201 executes various programs stored in the ROM 203 to implement the operation of the present embodiment. The printing apparatus 102 is equipped with line-type print heads corresponding to nozzle arrays of four colors, namely black, cyan, magenta, and yellow, respectively. Although the printing apparatus comprising the print heads corresponding to the above four colors is described as an example in the present embodiment, the printing apparatus may include print heads corresponding to colors other than the above four colors such as light cyan and light magenta and print heads corresponding to a particular color for a specific purpose. Each print head is detachably attached to a carriage or the like.

2. Printing Apparatus

Figure 3:
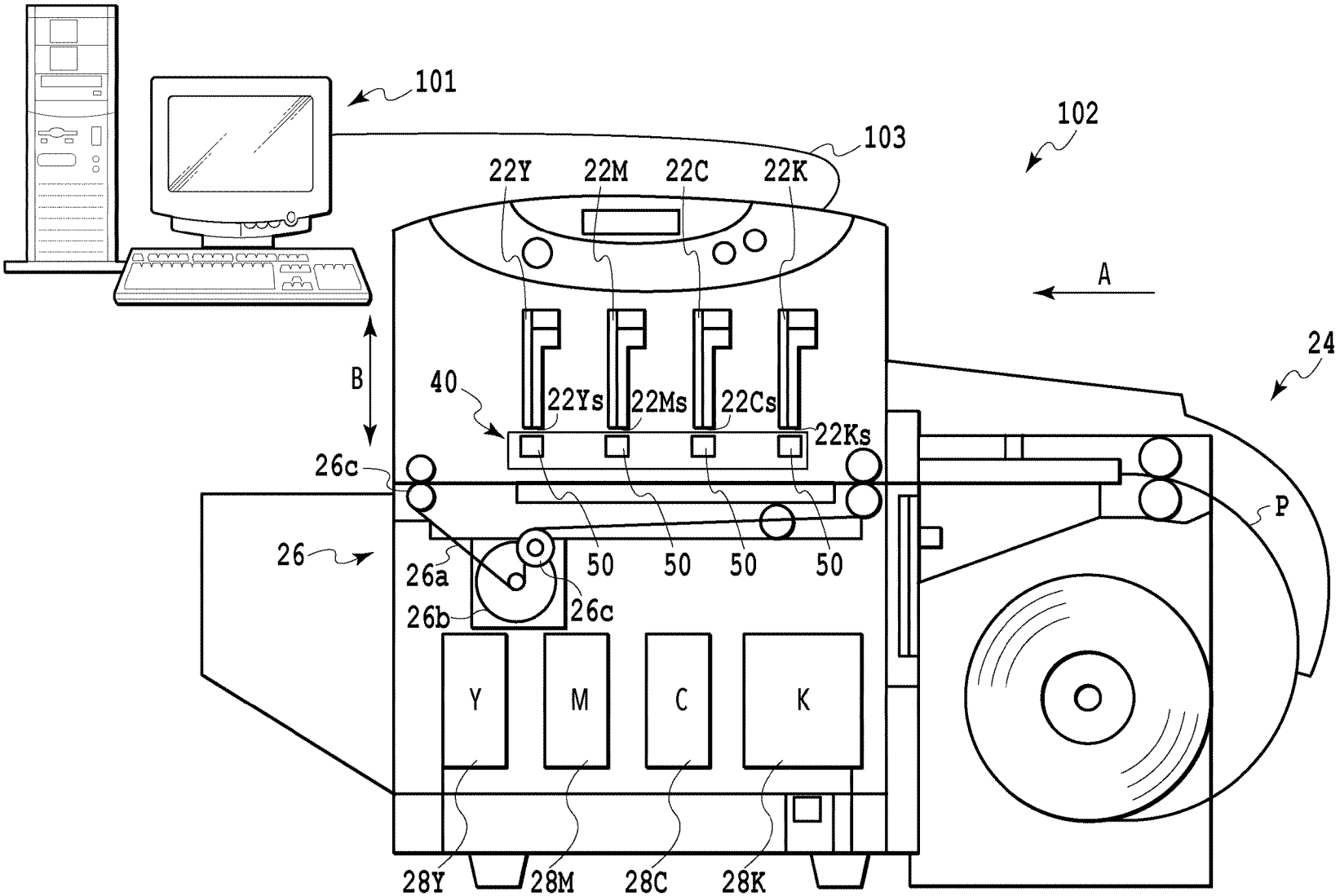
FIG. 3 is a front view showing a schematic configuration example of a printing apparatus that is a constituent element of the printing system.

FIG. 3 is a view showing a configuration of the printing apparatus 102 in the present embodiment. The printing apparatus 102 performs printing by ejecting inks of respective colors from print heads 22K, 22C, 22M, and 22Y on a print medium P based on print data to be used for printing transmitted from the host apparatus 101. The print heads 22K, 22C, 22M, and 22Y corresponding to the respective four colors are arranged in parallel in this order in the conveying direction of the print medium P (arrow A direction). The print heads 22K, 22C, 22M, and 22Y eject black (K), cyan (C), magenta (M), and yellow (Y) inks, respectively. Each of the print heads 22K, 22C, 22M, and 22Y is a so-called full-line type print head and has nozzles arrayed in a direction intersecting with the conveying direction A of the print medium (in the present embodiment, a direction orthogonal to the conveying direction A; hereinafter also referred to as a width direction). The nozzles correspond to a print medium having the largest dimension in the width direction and are arrayed in a range wider than the largest print width of the print medium. The print medium P is conveyed in the direction shown by arrow A (hereinafter also referred to as a medium conveying direction). On the other hand, the print heads eject inks and perform printing without moving by driving ejection energy generating elements (such as electrothermal transducing elements or piezoelectric elements) provided in nozzles in a range corresponding to a print width.

If an ejection state is changed by adhesion of foreign matter such as dust particles and ink droplets to ejection opening forming surfaces of the print heads 22K, 22C, 22M, and 22Y along with printing by the print heads, the quality of a printed image may be affected. In addition, ink inside ejection openings may be thickened. Accordingly, the printing apparatus 102 has a recovery unit 40 so as to eject ink stably from each of the print heads 22K, 22C, 22M, and 22Y The CPU 220 keeps or recovers a good ink ejection state of the print heads 22K, 22C, 22M, and 22Y by regular recovery processing of the recovery unit 40. The recovery unit 40 is equipped with a cap unit 50 corresponding to each print head and including a cap configured to cap the ejection opening forming surface while printing operation is not performed. For cleaning the ejection opening forming surface, the cap unit 50 comprises a blade for performing wiping operation of the ejection opening forming surface and a blade holding member. The cap unit 50 further comprises a unit configured to remove ink received by the cap during so-called suction recovery and preliminary ejection. In addition, the printing apparatus 102 is equipped with ink tanks 28K, 28C, 28M, and 28Y storing inks to be supplied to the respective print heads, pumps configured to fill the respective print heads with the inks, pumps used for recovery operation, and the like.

The print medium P, which is shown as a roll sheet in FIG. 3 for example, is fed from a roll sheet feeding unit 24 and conveyed in the arrow A direction by a conveying mechanism 26 provided in the printing apparatus 102. The conveying mechanism 26 includes a conveying belt 26*a* for placing and conveying the print medium P, a conveying motor 26*b* for rotating the conveying belt 26*a*, a roller 26*c* for applying tension to the conveying belt 26*a*, and the like. A conveying speed can be changed and set in several levels such as a high-speed mode and a low-speed mode, and particularly, in the present embodiment, set based on data about a maximum concurrent drive number (maximum concurrent ejection number; described later) of nozzles included in print data transmitted from the host apparatus 101. During printing, when the print medium P conveyed at the set speed reaches a position under the print head 22K, the CPU 220 drive the print head 22K to eject black (K) ink based on image data included in print data. Similarly, the CPU 22 drives the print heads 22C, 22M, and 22Y in this order to eject inks of the respective colors, thereby performing color printing on the print medium P. At this time, the CPU 220 drives the print heads while performing registration processing based on preset adjustment values. The print medium is not limited to a roll sheet and may be fanfold paper. Further, the print medium is not limited to continuous paper in the form of a web and may be a print medium 104 in the form of a cut sheet as shown in FIG. 1.

3. Registration Processing

The CPU 220 determines a standard value of an ejection timing of each print head based on a relationship between the conveying speed and distances between the print heads. However, an error in mounting positions of the print heads leads to print position deviation (deviation of the positions of dots formed by nozzles). To correct the print position deviation, the CPU 220 determines an ejection timing adjustment value using a test pattern composed of pattern elements printed at regular intervals at the time of installation of the printing apparatus 102 or at a time when a user requests correction of the position deviation. This value is used for adjustment of the ejection timing in the conveying direction of the print medium P, which corresponds to the vertical adjustment described above. Further, depending on the position deviation between the print heads in the ejection opening array direction, the horizontal adjustment for adjusting the range of ejection openings to be used for printing between the print heads and the inclination adjustment based on an inclination of the print heads with respect to the conveying direction are also performed.

Power necessary for conveyance of the print medium P, ink ejection operation from each print head (22K, 22C, 22M, and 22Y), and the like is supplied from a single power supply unit (not shown). The necessary power is not constant and increases with the conveying speed of the print medium P and the total number of nozzles of the print heads driven concurrently (concurrent ejection number). Not many images require formation of dots at high density in a large area by, for example, concurrent ejection from substantially all the nozzles of the print heads (22K, 22C, 22M, and 22Y). In view of this, it is not so advantageous to use a power supply unit having such a large capacity as to enable concurrent ejection from all the nozzles of the print heads (22K, 22C, 22M, and 22Y) during conveyance operation in a mode of conveying the print medium P at high speed. Therefore, the power supply capacity of the power supply unit is minimized and the mode is automatically changed to a low-speed mode in a case where a concurrent ejection number (the number of nozzles) of each print head exceeds a predetermined number (the number of dots as a threshold of power supply capacity), thereby dealing with high-duty image data, namely high-density image data.

The vertical adjustment, the horizontal adjustment, and the inclination adjustment will be described below.

3-1. Vertical Adjustment

Figure 4A:
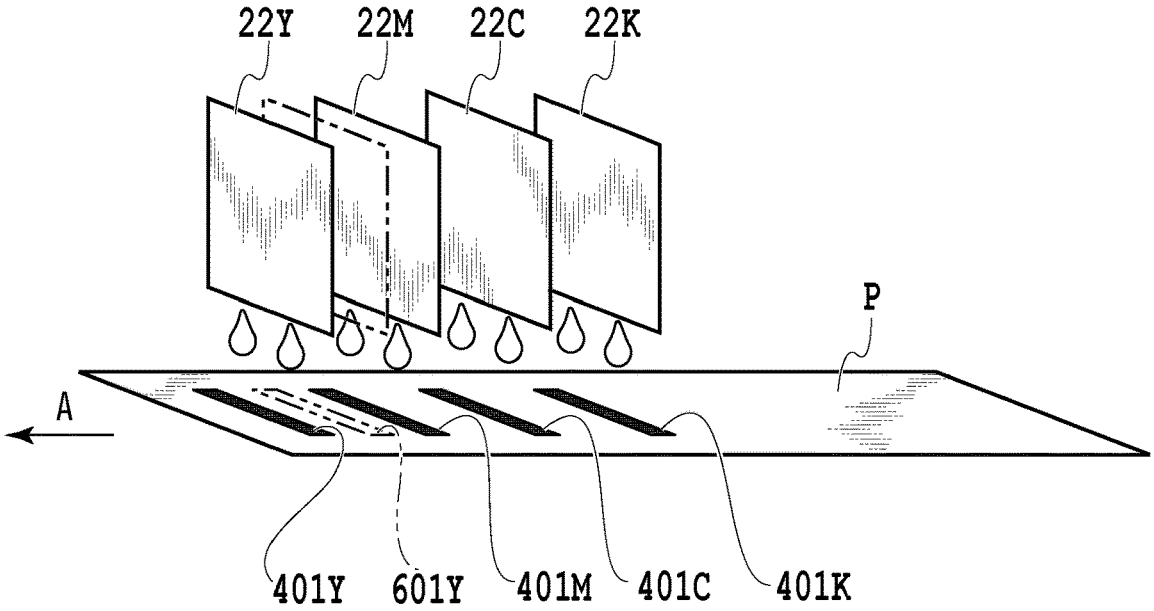
FIGS. 4A and 4B are explanatory diagrams illustrating vertical adjustment.
Figure 4B:
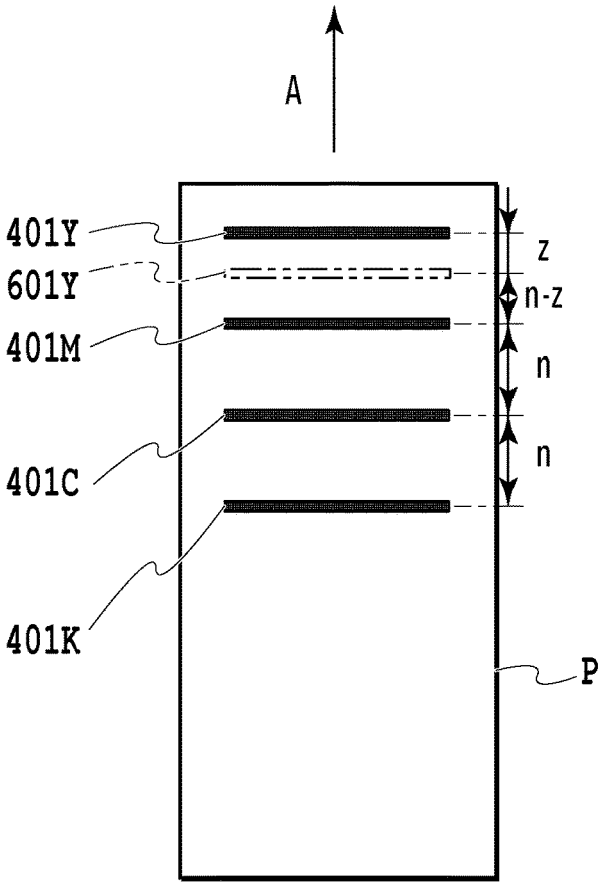

FIG. 4A and FIG. 4B are diagrams showing, by solid lines, printing operation in a state where distances between the print heads are uniform. In a case where the print heads 22K, 22C, 22M, and 22Y concurrently perform ejection operation on the print medium P conveyed in the arrow A direction, images 401K, 401C, 401M, and 401Y in the form of ruled lines extending in the width direction of the print medium are printed on the print medium P at regular intervals.

FIG. 4A also shows printing operation in a state where distances between the print heads are not uniform, that is, in a state where the print head 22Y is displaced in a direction opposite to the medium conveying direction A as shown by chain double-dashed lines. In a case where the print heads 22K, 22C, 22M, and 22Y concurrently perform ejection operation in this state, images 401K, 401C, and 401M at regular intervals and an image 601Y having a reduced interval to the image 401M are formed on the print medium P as shown by a chain double-dashed line in FIGS. 4A and 4B.

An interval (mm) between two arbitrary points in the arrow A direction (corresponding nozzles of adjacent print heads in the arrow A direction) on the print medium P can be converted into the number of dots by using a print resolution (dpi) in the arrow A direction. In a case where an interval between adjacent print heads is a specified interval, that is, in a case where each of an interval between the print heads 22K and 22C and an interval between the print heads 22C and 22M is a specified interval, it is assumed that the specified interval corresponds to n dots. In this state, the images 401K, 401C, and 401M are formed at regular intervals of n dots in the arrow A direction. In contrast, in a case where the print head 22Y is displaced to the print head 22M side by z dots as shown by the chain double-dashed line, an interval between the images 601Y and 401M corresponds to (n−z) dots. Accordingly, in the case of adjusting ejection timings of adjacent print heads to n dots based on the interval between the images 401M and 601Y formed by concurrent ejection, the ejection timing of the print head 22Y is set at a timing earlier by a time period Z obtained by dividing z dots by the set conveying speed. In the present embodiment, the Z value at this time is defined as an ejection timing adjustment value or a vertical adjustment value. In a case where the ejection timing is required to be late, that is, for example, in a case where the print head 22Y is displaced by z dots in a direction away from the print head 22M, a negative value of Z (−Z) can be set as the ejection timing adjustment value.

On the contrary, on the basis of the state where the ejection timing has already been adjusted, for example, if it is found that the ejection timing adjustment value is Z, the ejection timings of the print heads 22K to 22Y can be set so that an interval between images formed by concurrent ejection corresponds to a certain number of dots (n−z).

3-2. Horizontal Adjustment

Figure 5A:
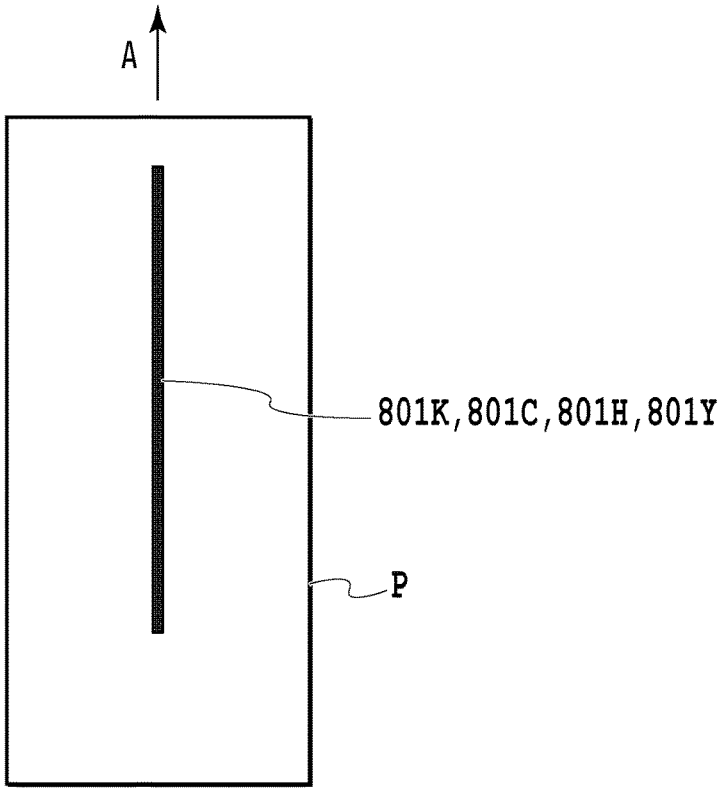
FIGS. 5A and 5B are explanatory diagrams illustrating horizontal adjustment.

FIG. 5A shows a print medium P from above in the vertical direction, on which images are printed in a state where the positions of the print heads are aligned in the horizontal direction, or nozzle array direction. Images 801K, 801C, 801M, and 801Y are printed at the same position by using a nozzle at the center position of each print head in the horizontal direction.

Figure 5B:
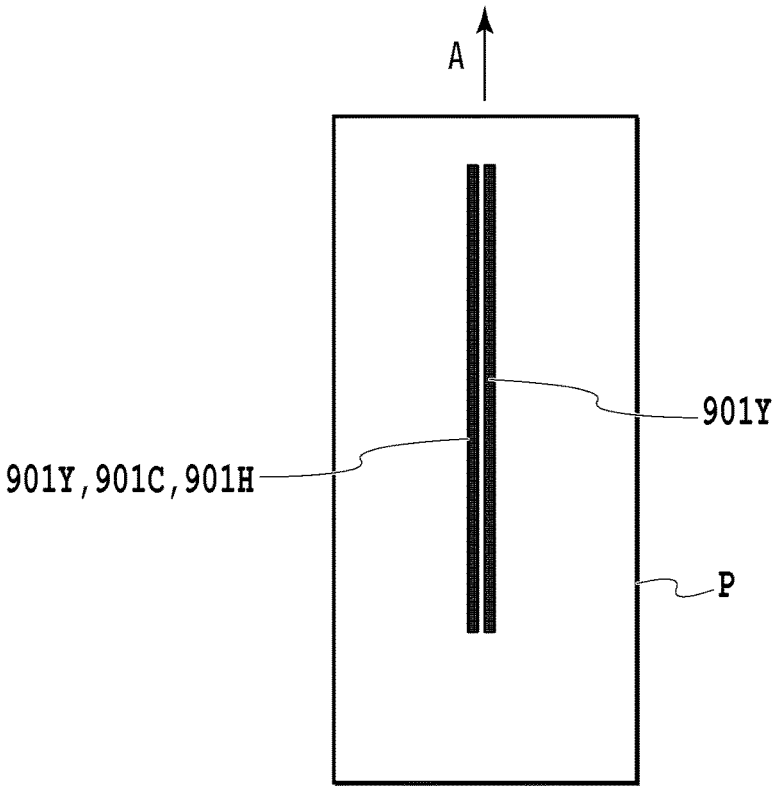

FIG. 5B shows a print medium P from above in the vertical direction, on which an image is printed by using a nozzle at the center of each print head in the horizontal direction in a state where the horizontal positions of the print heads are misaligned, and more specifically, in a state where the print head 22Y is displaced from the other print heads to the right side in the drawing. In this case, images 901K, 901C, and 901M are printed at the same position and overlap one another, whereas only an image 901Y is printed at a position displaced to the right. It is assumed that the amount of displacement corresponds to r dots.

As described above, the nozzles of each print head correspond to a print medium having the largest dimension in the width direction and are arrayed in a region wider than the largest print width of the print medium. That is, both sides of each print head has a predetermined number of extra nozzles that are arranged uniformly, for example. Printing is generally performed by using the most of a group of nozzles in the central area exclusive of the extra nozzles, but the extra nozzles are used if there is a need for horizontal adjustment. To avoid the deviation of the image 901Y as shown in FIG. 5B, printing operation is performed while a use range of nozzles of only the print head 22Y is shifted by r dots (=r nozzles) to the left. This r value is defined as an adjustment value for registration in the horizontal direction, or a horizontal adjustment value (nozzle array direction adjustment value). The use range can be shifted to the left in the drawing by setting the horizontal adjustment value at a positive value of r (+r) and shifted to the right by setting the horizontal adjustment value at a negative value of r (−r).

The horizontal adjustment is used not only for avoiding color deviation in the horizontal direction but also for horizontally shifting the nozzle use ranges of the print heads of all the colors to prevent a load from being applied to a specific nozzle by continuously forming vertical ruled lines (images in the form of vertical ruled lines extending in the medium conveying direction) at the same position. Since the present embodiment has no need to distinguish between horizontal color deviation adjustment and adjustment for shifting vertical ruled lines, they can be collectively treated as horizontal adjustment.

3-3. Inclination Adjustment

Figure 6A:
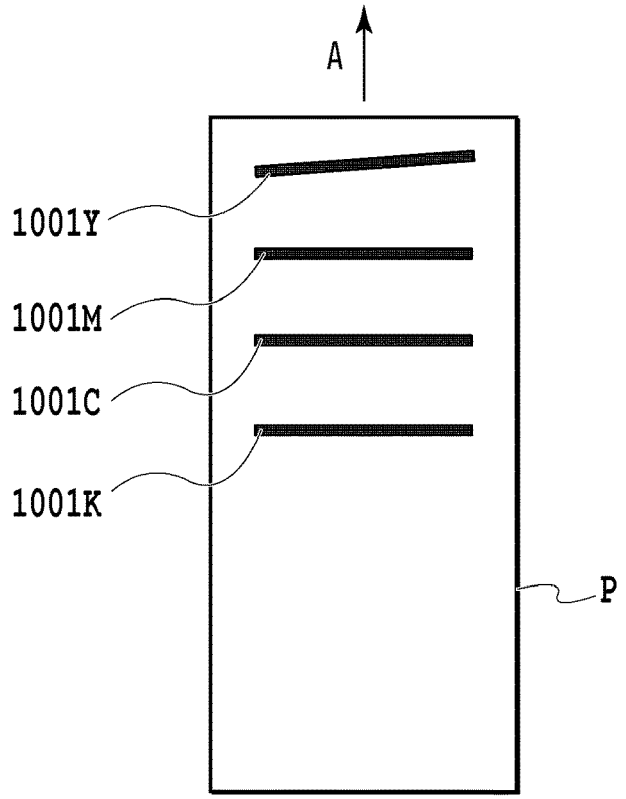
FIGS. 6A and 6B are explanatory diagrams illustrating inclination adjustment.

FIG. 6A shows a print medium P from above in the vertical direction, for which printing operation is performed in a state where the print heads are not in parallel to one another, and more specifically, in a state where the print head 22Y is inclined with respect to the medium conveying direction A and the width direction orthogonal to the medium conveying direction A. In this case, even if images to be formed in the direction orthogonal to the medium conveying direction A are printed, images 1001K, 1001C, and 1001M are printed in parallel, whereas an image 1001Y is printed at an inclination. Although FIG. 6A emphasizes the inclination, the inclination adjustment will be described below on the assumption that the actual inclination of the image 1001Y from the left end to the right end corresponds to one dot.

Figure 6B:
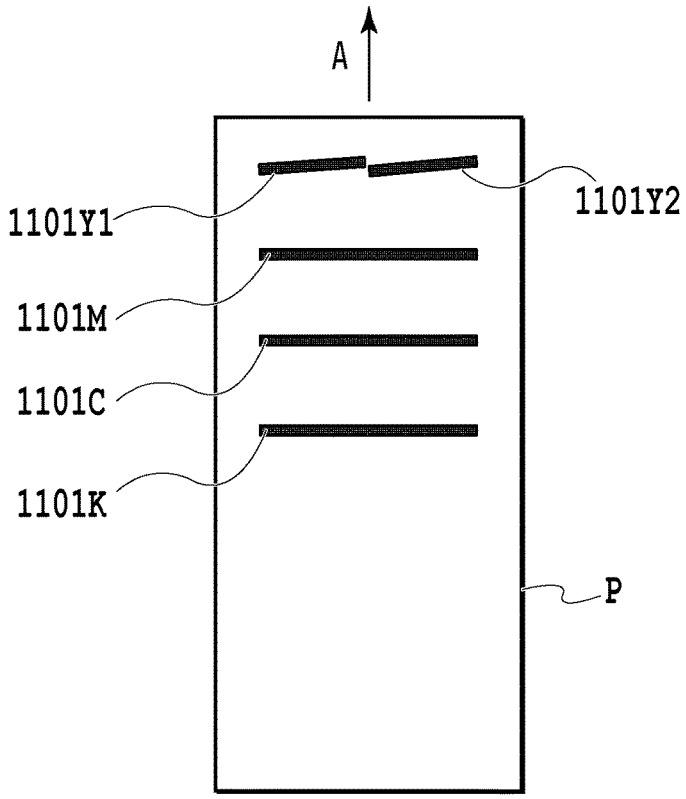

FIG. 6B shows a print medium P from above in the vertical direction, for which printing is performed after the inclination adjustment of the print head 22Y in a print head arrangement state that results in the printing as shown in FIG. 6A. To be more specific, FIG. 6B shows a printing result of dividing the use nozzle range of the print head 22Y at the center and delaying the ejection timing of the right half nozzles from that of the left half nozzles by a time required for printing one dot in the conveying direction. As a result, an image portion 1101Y1 printed by the left half nozzles is formed at the same position as the left half of the image 1001Y in FIG. 6A and an image portion 1101Y2 printed by the right half nozzles is formed at a position shifted by one dot upstream in the conveying direction, which makes the inclination of the image inconspicuous. This state is defined as a state where an inclination adjustment value of the print head is "1." In a case where the inclination of the print head from the left end to right end corresponds to two dots, the boundary between the image portions 1101Y1 and 1101Y2 becomes conspicuous if the image portions are shifted by two dots at the center of the use nozzle range of the print head. In this case, a division is not made at the center. The use nozzle range is divided into three blocks at division positions of ⅓ and ⅔ from the left end of the print head so as to perform inclination adjustment by one dot per block, namely by two dots in total. This can be generalized as follows: in the case of an inclination corresponding to s dots, a division position is set per 1/(s+1) from the left end of the print head and inclination adjustment is performed by one dot between adjacent parts of the use nozzle range divided at each division position, namely by s dots in total. If an inclination is opposite to that shown in FIG. 6A, a negative value is set as the inclination adjustment value.

The various adjustment values described above are input to the host apparatus 101 by a user after the user visually determines a test pattern output by the printing apparatus 102, whereby the values are stored in the EEPROM 213 of the printing apparatus 102. In a case where the printing apparatus 102 comprises an input unit that accepts input by a user, the values may be set via the input unit.

4. Characteristic Configuration of Embodiment

The CPU 201 performs printing operation while performing registration based on the adjustment values described above. At this time, the conveying speed of the print medium P is changed based on data about a maximum concurrent ejection number calculated by the host apparatus 101. In a conventional method, as described above, in the case of creating print data, the host apparatus 101 acquires adjustment values to be reflected in calculation from the printing apparatus 102 and performs calculation. Accordingly, printing operation cannot be started immediately after the establishment of communication between them. Further, there is a case where the printing system is configured so that a plurality of printing apparatuses are connected to the host apparatus 101 and the same image can be printed. In this case, the host apparatus 101 is required to receive adjustment values from each printing apparatus and perform concurrent ejection number calculation based on the adjustment values specific to each printing apparatus. As a result, the host apparatus 101 cannot efficiently perform processing. Further, if the printing apparatus 102 receives only image data from the host apparatus 101 and the CPU 201 performs concurrent ejection number calculation based on the image data and the adjustment values set for the printing apparatus 102, it takes time to start printing.

In view of the above, in the present embodiment, the host apparatus 101 calculates a maximum value of the number of nozzles that may be driven (hereinafter "maximum concurrent ejection number") based on the image data and the amount of deviation of dot formation positions that may occur in the printing apparatus 102. Then, the host apparatus 101 transmits maximum concurrent ejection number data together with the image data to the printing apparatus 102. In the printing apparatus 102, the CPU 201 sets the conveying speed based on the received maximum concurrent ejection number data.

Figure 7:
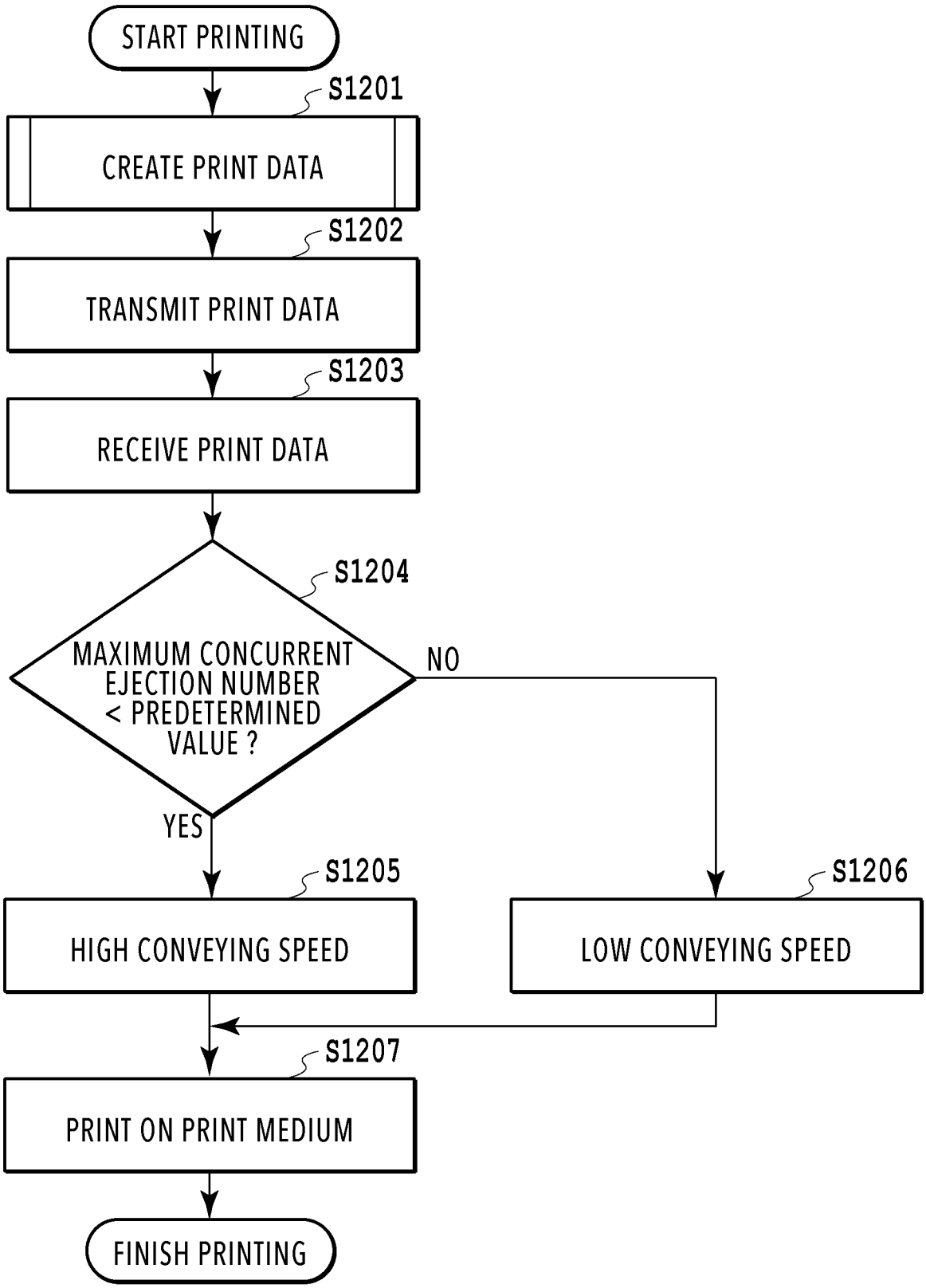
FIG. 7 is a flowchart providing an overview of operation of the printing system shown in FIG. 2.

FIG. 7 is a flowchart showing an overview of operation of the printing system from print data creation by the CPU 220 executing the printer driver loaded into a main memory 222 of the host apparatus 101 to printing by the printing apparatus 102. Steps S1201 and S1202 are executed on the host apparatus 101 side and steps S1203 to S1207 are executed on the printing apparatus 102 side.

First, in step S1201, the CPU 220 creates print data. This will be described later in detail with reference to the flowchart of FIG. 8. The processing then advances to step S1202 and the print data created by the CPU 220 is transmitted to the printing apparatus 102.

The CPU 201 of the printing apparatus 102 receives the print data in step S1203 and analyzes maximum concurrent ejection number data included in the print data (step S1204). Then, the CPU 201 sets the conveying speed at high speed (step S1205) if the maximum concurrent ejection number is less than a predetermined value and sets the conveying speed at low speed (step S1206) if the maximum concurrent ejection number is equal to or greater than the predetermined value. After that, the processing advances to step S1207. The CPU 201 performs printing operation on the print medium 104 and finishes the printing operation. The printing operation in step S1207 is performed based on various adjustment values set for the printing apparatus 102.

Instead of the CPU 201 of the printing apparatus 102 analyzing the maximum concurrent ejection number data, the CPU 220 of the host apparatus 101 can directly determine a printing speed based on the maximum concurrent ejection number data. In this case, data designating the printing speed is added to the print data and transmitted to the printing apparatus 102. The CPU 201 of the printing apparatus 102 sets the printing speed based on this designation of the printing speed.

Figure 8:
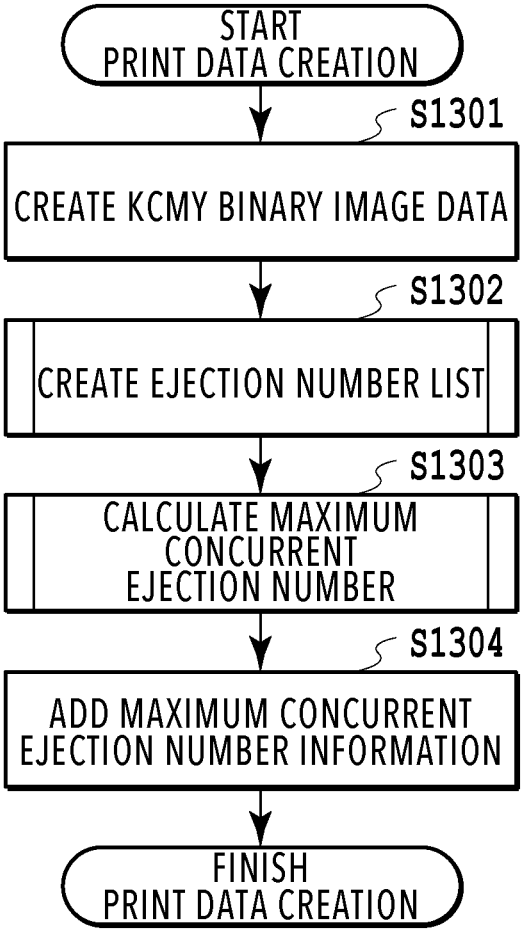
FIG. 8 is a flowchart showing the details of the procedure of print data creation processing in FIG. 7.

FIG. 8 is a flowchart showing the details of the print data creation in step S1201 of FIG. 7. First, in step S1301, the CPU 220 of the host apparatus 101 creates K, C, M, and Y binary image data corresponding to the respective print heads and then advances to step S1302. In step S1302, the CPU 220 creates an ejection number list, which will be described later in detail with reference to FIG. 9 and FIG. 10. After that, the CPU 220 advances to step S1303 and calculates the maximum concurrent ejection number by using the ejection number list. This will be described later in detail with reference to the flowchart of FIG. 16. Then, the CPU 220 advances to step S1304, adds the maximum concurrent ejection number information to the print data, and finishes the print data creation. Step S1303 executed by the CPU 220, namely the procedure shown in FIG. 16 corresponds to an acquisition unit.

FIG. 9 shows the ejection number list. Here, it is assumed that one image to be printed is composed of L rasters (equal to the number of dots in the conveying direction). In this case, the ejection number list stores an ejection number in each of the first raster at the front end of the image to the L-th raster at the rear end of the image in the conveying direction for each of K, C, M, and Y. Although the ejection number list is entirely filled with "0" before the start of ejection number calculation, the list is updated each time a current maximum concurrent ejection number appears in course of the calculation. The example of FIG. 9 shows a state where the maximum concurrent ejection number "2000" is stored in the x-th raster of K.

Figure 10:
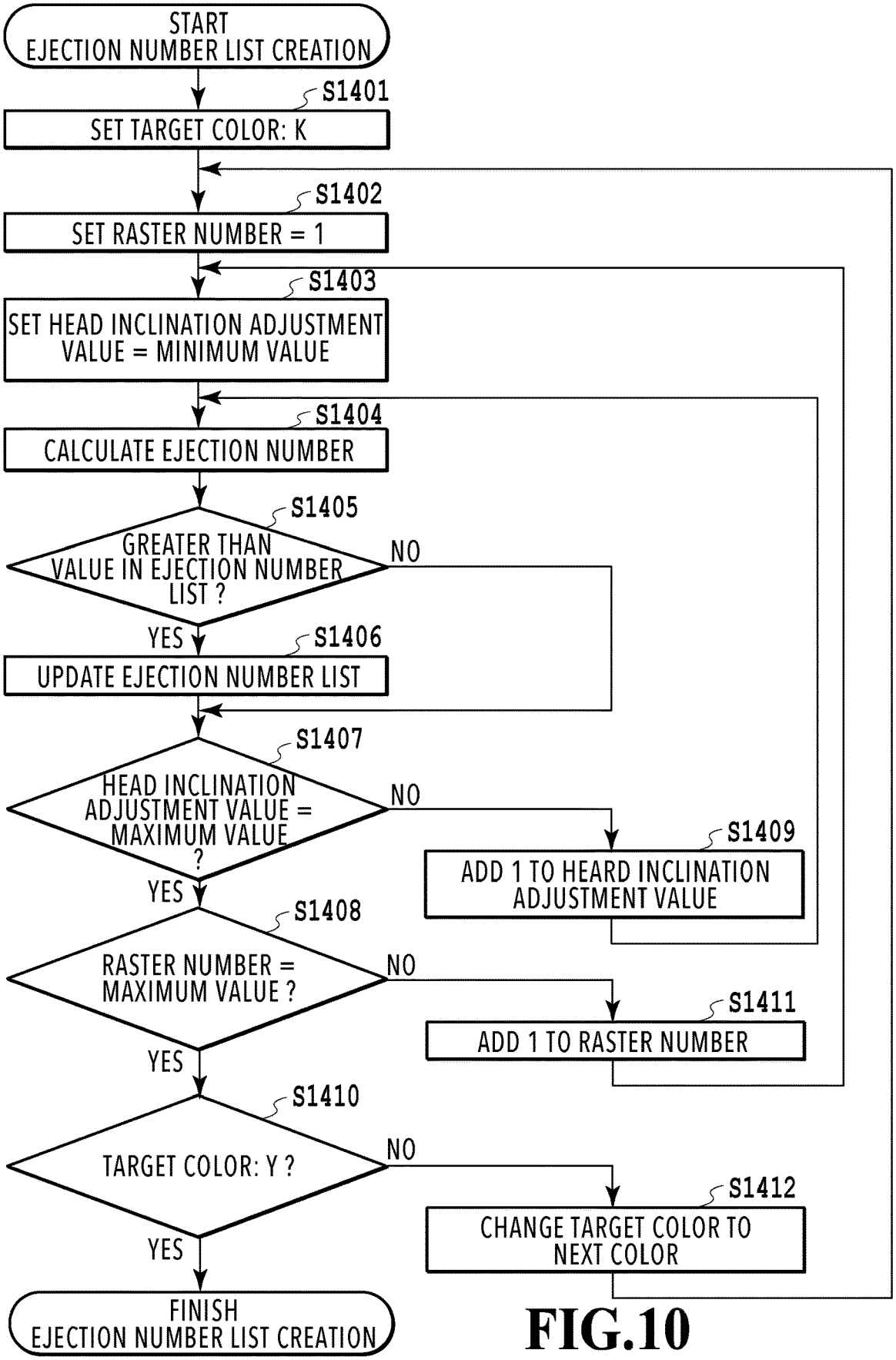
FIG. 10 is a flowchart showing the details of the procedure of creating the ejection number list of FIG. 9.

FIG. 10 is a flowchart providing the details of the ejection number list creation in step S1302 of FIG. 8. First, in step S1401, the CPU 220 of the host apparatus 101 sets, as a target color of ejection number list creation, K (black) ejected by the print head 22K located on the most upstream side in the medium conveying direction A, and then advances to step S1402. In step S1402, the CPU 220 sets a raster number for ejection number list creation at "1" and advances to step S1403.

A print head inclination adjustment value used for calculation described below is set based on an assumed inclination. In the present embodiment, it is assumed that the value can be set in a range from −hs to +hs (hs is a positive integer). In step S1403, a minimum value −hs is set as an inclination adjustment value of the print head of the target color (K at first). Next, the processing advances to step S1404 and ejection number calculation is performed. An ejection number calculation method will be described below with reference to FIG. 11 to FIG. 15.

Figure 11:
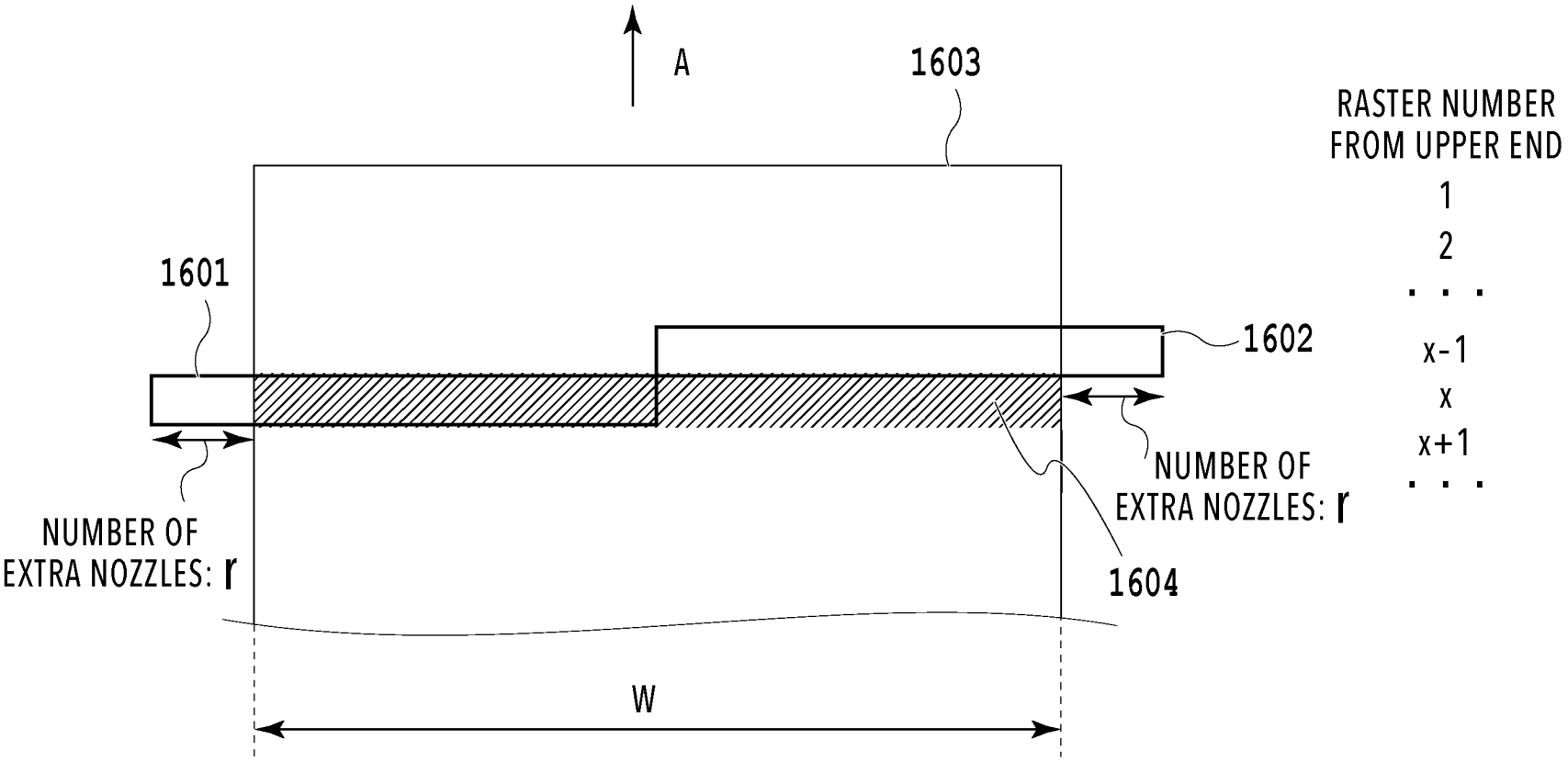
FIG. 11 is an illustration of an ejection number change by horizontal adjustment and inclination adjustment.

FIG. 11 is a diagram showing ejection numbers in a state where the horizontal adjustment value is 0 and the inclination adjustment value is +1. A rectangular region 1603 surrounded with a thin line represents binary image data, where the upstream side in the medium conveying direction A is omitted and shown by broken lines. A diagonally shaded portion 1604 represents a dot-ON region (a region filled with dots). In this example, the x-th raster from the front end of the image on the upper side of the drawing is entirely in a dot-ON state and all the other rasters are in a dot-OFF state. A rectangular region 1601 surrounded with a thick line represents a region in which printing is performed by nozzles in the left half of the print head. To show a relation between the horizontal adjustment value and the ejection number, the region 1601 includes a portion corresponding to the number of extra nozzles r at the left end. A rectangular region 1602 surrounded with a thick line represents a region in which printing is performed by nozzles in the right half of the print head. The region 1602 includes a portion corresponding to the number of extra nozzles r at the right end. On the assumption that the width of the binary image data 1603 corresponds to w dots, the number of dots (the number of nozzles) is (w/2)+r in each of the right half and left half of the print head. At the moment that the left end of the print head is located at the x-th raster from the front end of the image as shown in FIG. 11, an ejection number in the region 1601 printed by the left half of the print head is w/2 dots, an ejection number in the region 1602 printed by the right half of the print head is 0 dots, and the sum of the left and right is w/2 dots.

Figure 12:
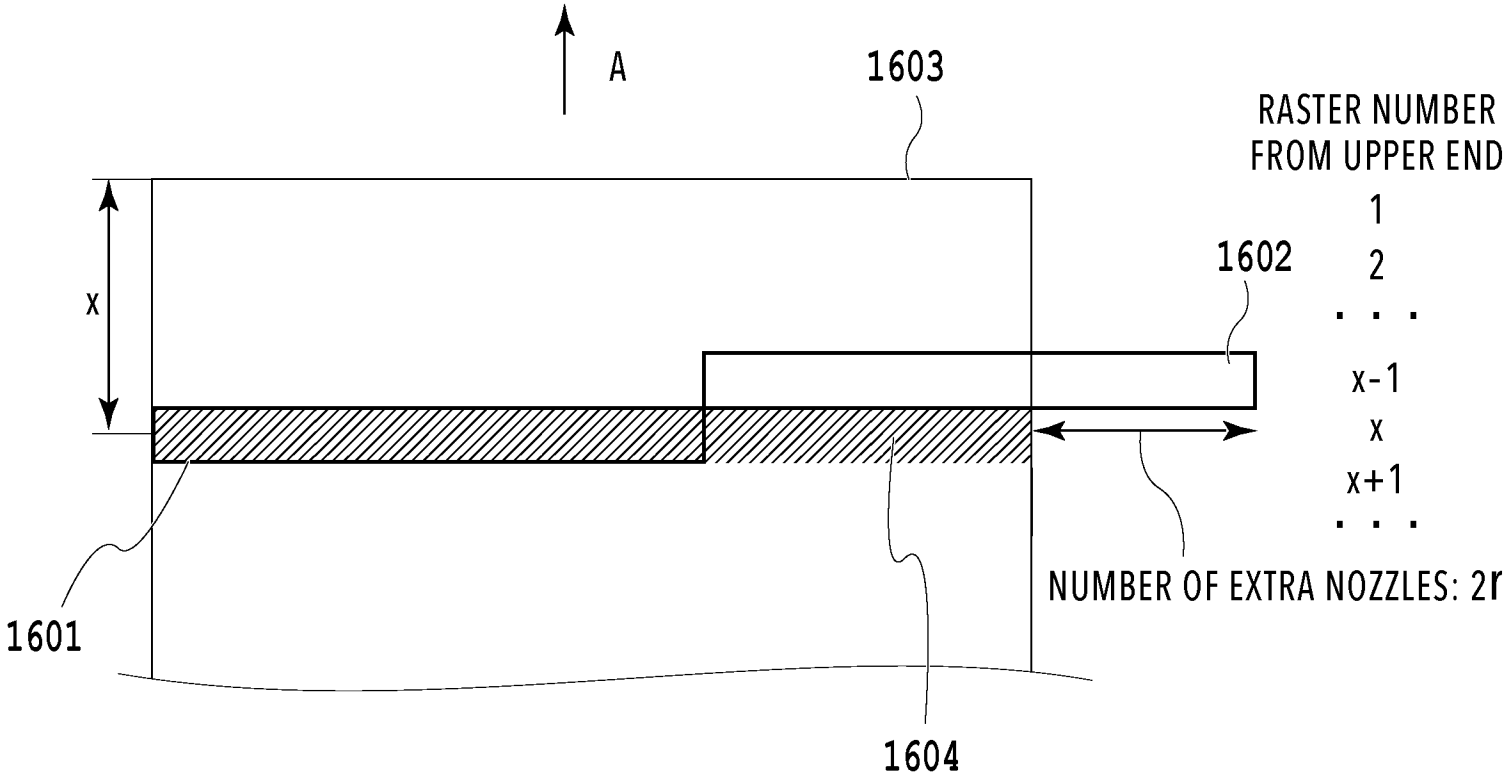
FIG. 12 is an illustration of an ejection number change by horizontal adjustment and inclination adjustment.

FIG. 12 shows ejection numbers in a state where the horizontal adjustment value is the maximum value +r and the print head inclination adjustment value is +1. At the moment that the left end of the print head is located at the x-th raster from the front end of the image as shown in FIG. 12, an ejection number in the region 1601 printed by the left half of the print head is (w/2)+r dots, which is equal to the total number of nozzles in the left half, and an ejection number in the region 1602 printed by the right half of the print head is 0 dots. The sum of the left and right is thus (w/2)+r. This shows that the ejection number varies depending on the horizontal adjustment value even in the case of the ejection number in the same x-th raster with the same inclination adjustment value as that in FIG. 11.

Figure 13:
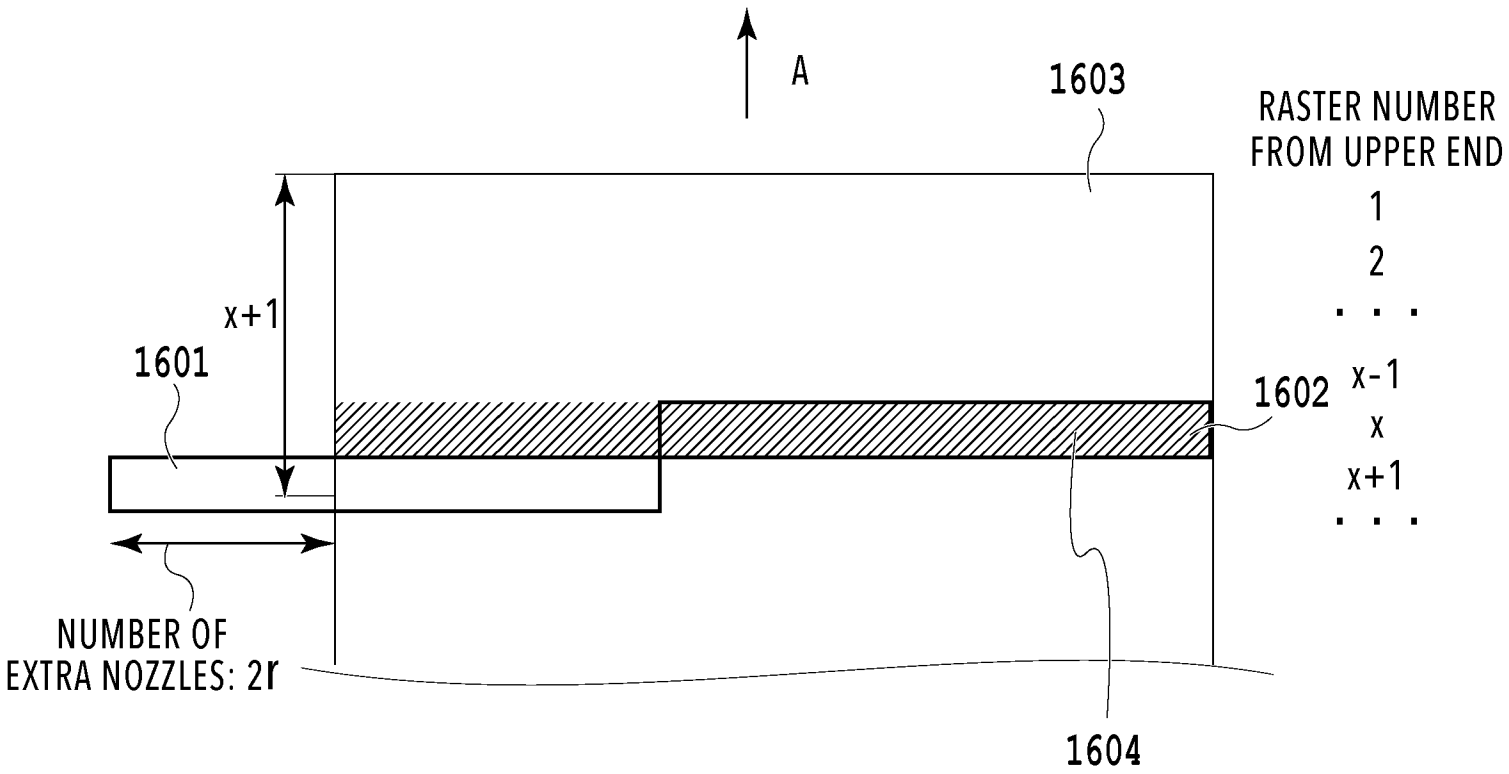
FIG. 13 is an illustration of an ejection number change by horizontal adjustment and inclination adjustment.

FIG. 13 shows ejection numbers in a state where the horizontal adjustment value is the minimum value −r and the head inclination adjustment value is +1. At the moment shown in FIG. 13, differently from FIG. 11 and FIG. 12, the print position of the right end of the head is the x-th raster from the front end of the image and the print position of the left end of the head is the (x+1)-th raster from the front end of the image. At this moment, an ejection number in the region 1601 printed by the left half of the print head is 0 dots, an ejection number in the region 1602 printed by the right half of the print head is (w/2)+r dots, which is equal to the total number of nozzles in the right half, and the sum of the left and right is (w/2)+r. In the examples of FIG. 11 and FIG. 12, the ejection number in the region 1602 printed by the nozzles in the right half of the print head is less than (w/2)+r dots at any time. However, FIG. 13 shows that the ejection number in the region 1602 printed by the right half of the print head may reach (w/2)+r dots with a change in the horizontal registration adjustment value.

A case where the host apparatus 101 calculates ejection numbers without obtaining the horizontal adjustment value from the printing apparatus 102 is assumed. In this case, in order to correctly calculate ejection numbers corresponding to all the moments (drive positions of nozzles corresponding to all the rasters), the CPU 220 of the host apparatus 101 is required to make calculation by the number of times obtained by shifting the horizontal adjustment value from −r to +r one by one, that is, (2r+1) times. Moreover, this calculation is for one head. The CPU 220 is required to make the calculation by the number of times obtained by multiplying the number of rasters L in one image by the total number of print heads.

Figure 14:
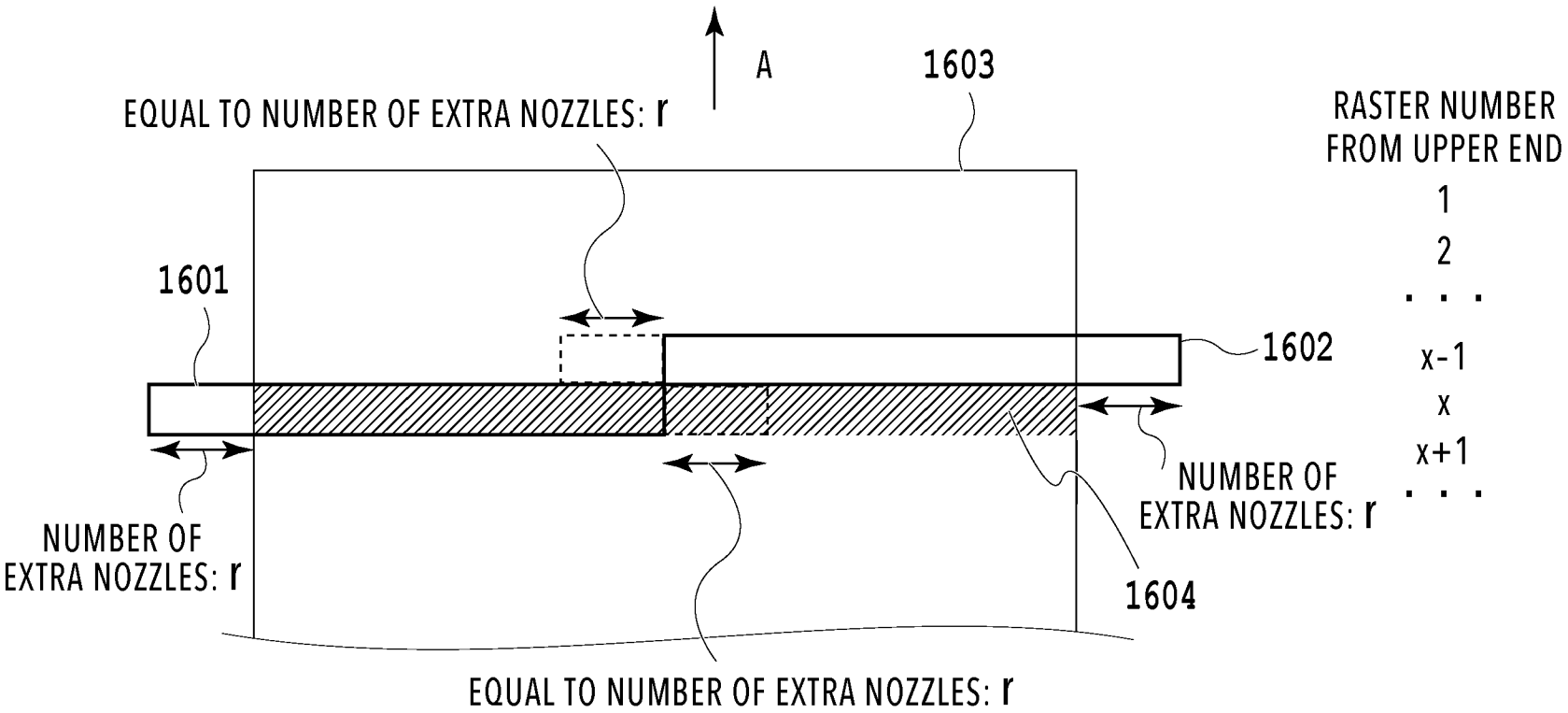
FIG. 14 is an illustration of a method of suppressing the ejection number change shown in FIG. 12.

FIG. 14 shows a calculation method for covering the entire range of the horizontal adjustment value without the need for the CPU 220 of the host apparatus 101 to make calculation multiple times. FIG. 14 is based on the assumption that a region shown by a thick broken line and corresponding to the number of extra nozzles r is added to the right side of the region 1601 printed by the left half of the print head and a region shown by a thick broken line and corresponding to the number of extra nozzles r is added to the left side of the region 1602 printed by the right half of the print head. A description will be provided below for a method of calculating ejection numbers in the print head at a certain moment, that is, in a predetermined raster in the region 1601, the region added to the region 1601, the region 1602, and the region added to the region 1602.

The sum of the ejection numbers in the region 1601 printed by the nozzles in the left half of the print head and the additional region thereof is (w/2)+r dots. That is, the region 1601 printed by the nozzles in the left half of the print head and the additional region thereof overlap the dot-ON shaded portion 1604 by (w/2)+r dots. In contrast, the sum of the ejection numbers in the region 1602 printed by the nozzles in the right half of the print head and the additional region thereof is 0 dots. That is, neither the region 1602 printed by the nozzles in the right half of the print head nor the additional region thereof overlaps the dot-ON shaded portion 1604.

As a result, the sum of the ejection numbers in the predetermined raster is (w/2)+r dots. This is a maximum value among possible values of the concurrent ejection number. In other words, the maximum possible concurrent ejection number can be obtained only by one calculation of adding the ejection number in the case of the maximum horizontal adjustment value of +r to the ejection number in the case of the minimum horizontal adjustment value of −r.

Figure 15:
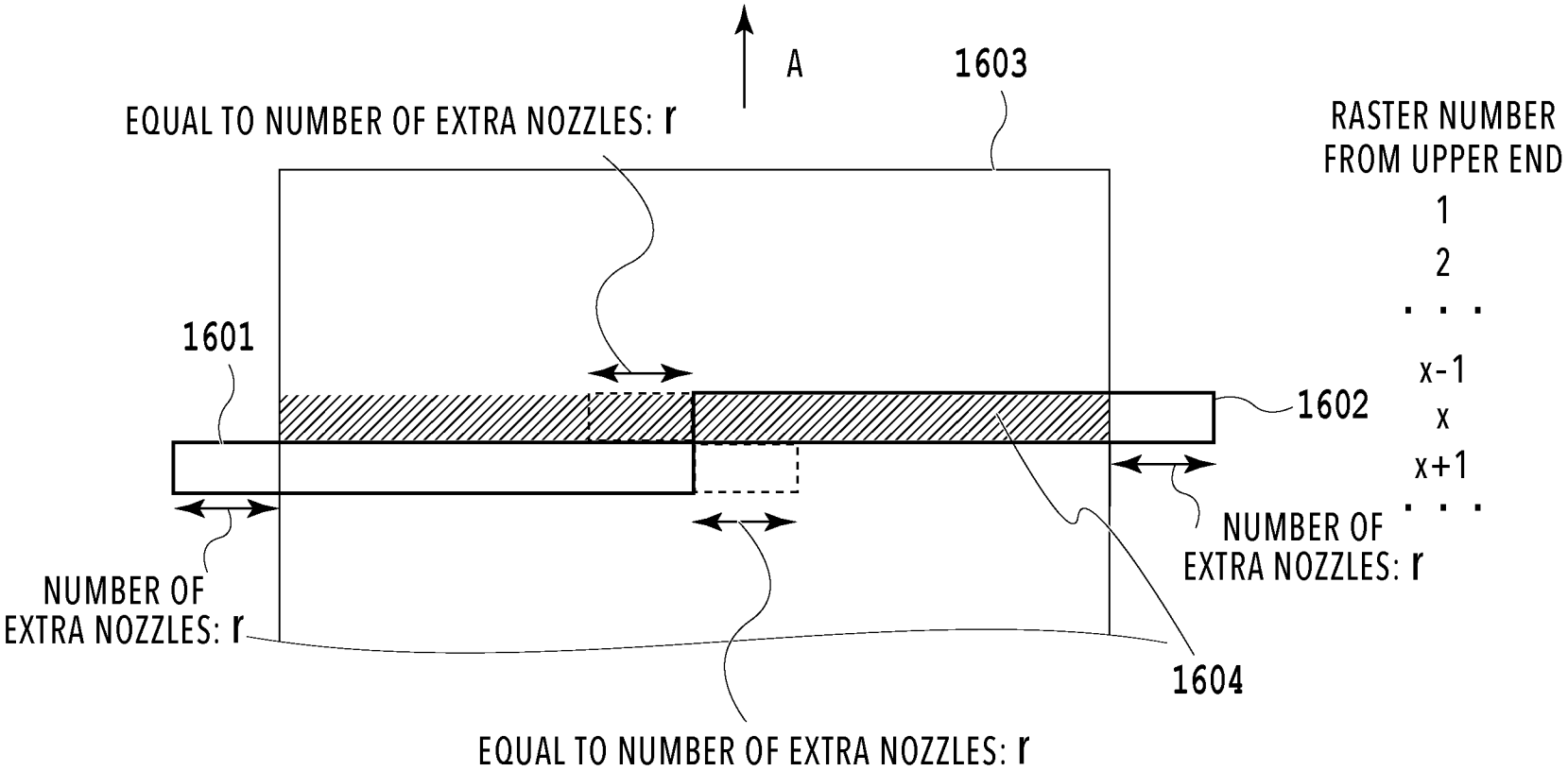
FIG. 15 is an illustration of a method of suppressing the ejection number change shown in FIG. 13.

FIG. 15 shows ejection numbers at a timing one dot (one raster) after FIG. 14. At this time, the ejection number in the region 1601 printed by the nozzles in the left half of the print head and the additional region thereof is 0 dots. The ejection number in the region 1602 printed by the nozzles in the right half of the print head and the additional region thereof is (w/2)+r dots. Accordingly, the sum of the ejection numbers in the print head at the timing one raster after the predetermined raster is (w/2)+r dots. FIG. 14 and FIG. 15 show the same binary image data 1603.

As shown in FIG. 14, the concurrent ejection number in the case where the print position of the left end of the print head is the x-th raster from the front end of the image is (w/2)+r dots on the condition that the horizontal adjustment value is r. In addition, as shown in FIG. 15, the concurrent ejection number in the case where the print position of the left end of the print head is the (x+1)-th raster is (w/2)+r dots on the condition that the horizontal adjustment value is −r.

However, the horizontal adjustment value is not switched at least during printing of one image. Thus, the above situation never actually occurs.

However, in the present embodiment, a higher priority is given to a calculation speed than the accuracy of a calculation result. Further, an error in a calculation result occurs in a direction of increasing the ejection number. Therefore, the error expands a margin of control and does not affect an image.

FIG. 10 is referred to again. Since the calculation is performed in the method shown in FIG. 14 and FIG. 15, the ejection number in the x-th raster calculated by the CPU 220 in step S1404 is based on the inclination adjustment value and the horizontal adjustment value in a case where the left end of the print head is in the x-th raster from the front end of image data. FIG. 11 to FIG. 15 show the examples in the case where the inclination adjustment value is +1. However, no matter what value in the above range from −hs to +hs the inclination adjustment value is, it is possible to use the same method of adding regions corresponding to the number of extra nozzles to the boundaries between all the regions surrounded with thick lines in FIG. 14 and FIG. 15.

Next, in step S1405, the CPU 220 determines whether the ejection number calculated in step S1404 is greater than a value stored in a position indicated by a raster number in a current target color in the ejection number list. If it is greater, the processing advances to step S1406. Otherwise the processing advances to step S1407. In step S1406, the CPU 220 updates the ejection number list by storing the ejection number calculated in step S1404 in the current position in the ejection number list and then advances to step S1407.

In step S1407, the CPU 220 determines whether the inclination adjustment value of the print head of the calculation target color has reached the maximum value hs. The processing advances to step S1408 if YES and advances to step S1409 if NO. In step S1408, the CPU 220 determines whether the raster number in the calculation target color has reached L (the number of rasters in one page). The processing advances to step S1410 if YES and advances to step S1411 if NO. On the other hand, in step S1409, the CPU 220 adds one to the inclination adjustment value for the print head of the calculation target color, returns to step S1404, and repeats the subsequent procedure.

In step S1410, the CPU 220 determines whether the calculation target color is Y that is ejected by the print head 22Y located on the most downstream side in the medium conveying direction. If the calculation target print head color is other than Y, the processing advances to step S1412. On the other hand, in step S1411, the CPU 220 adds one to the raster number in the calculation target color, returns to step S1403, and repeats the subsequent procedure.

In step S1412, the host apparatus 101 changes the calculation target color to the next color, returns to step S1402, and repeats the subsequent procedure. In the present embodiment, the print heads 22K, 22C, 22M, and 22Y are arranged in this order from the upstream side in the medium conveying direction. Accordingly, the calculation target color is switched in the order of K, C, M, and Y. If the calculation target color is Y in step S1410, the CPU 220 finishes the ejection number list creation.

Figure 16:
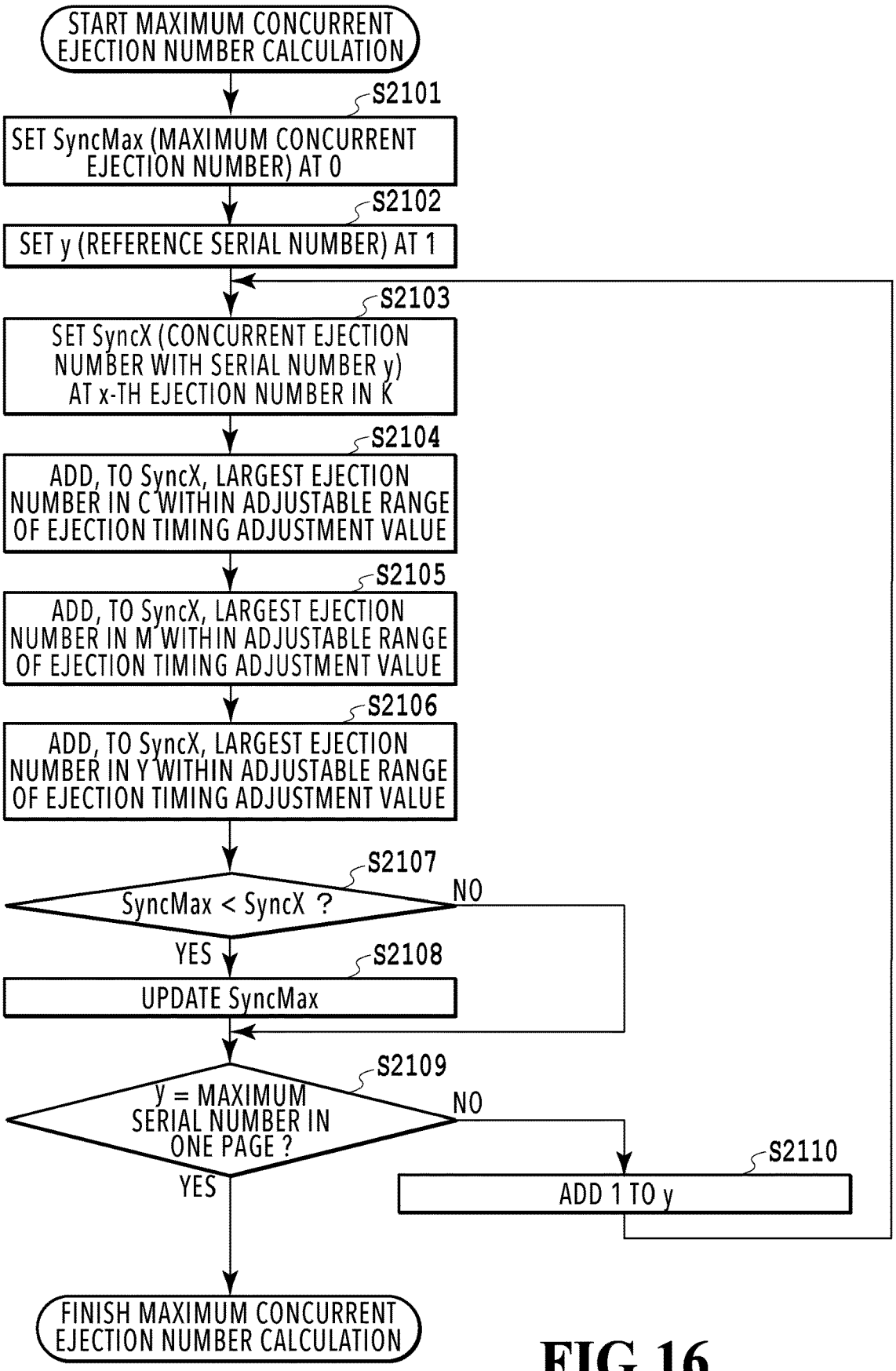
FIG. 16 is a flowchart of a maximum concurrent ejection number calculation procedure according to the embodiment.
Figure 17:
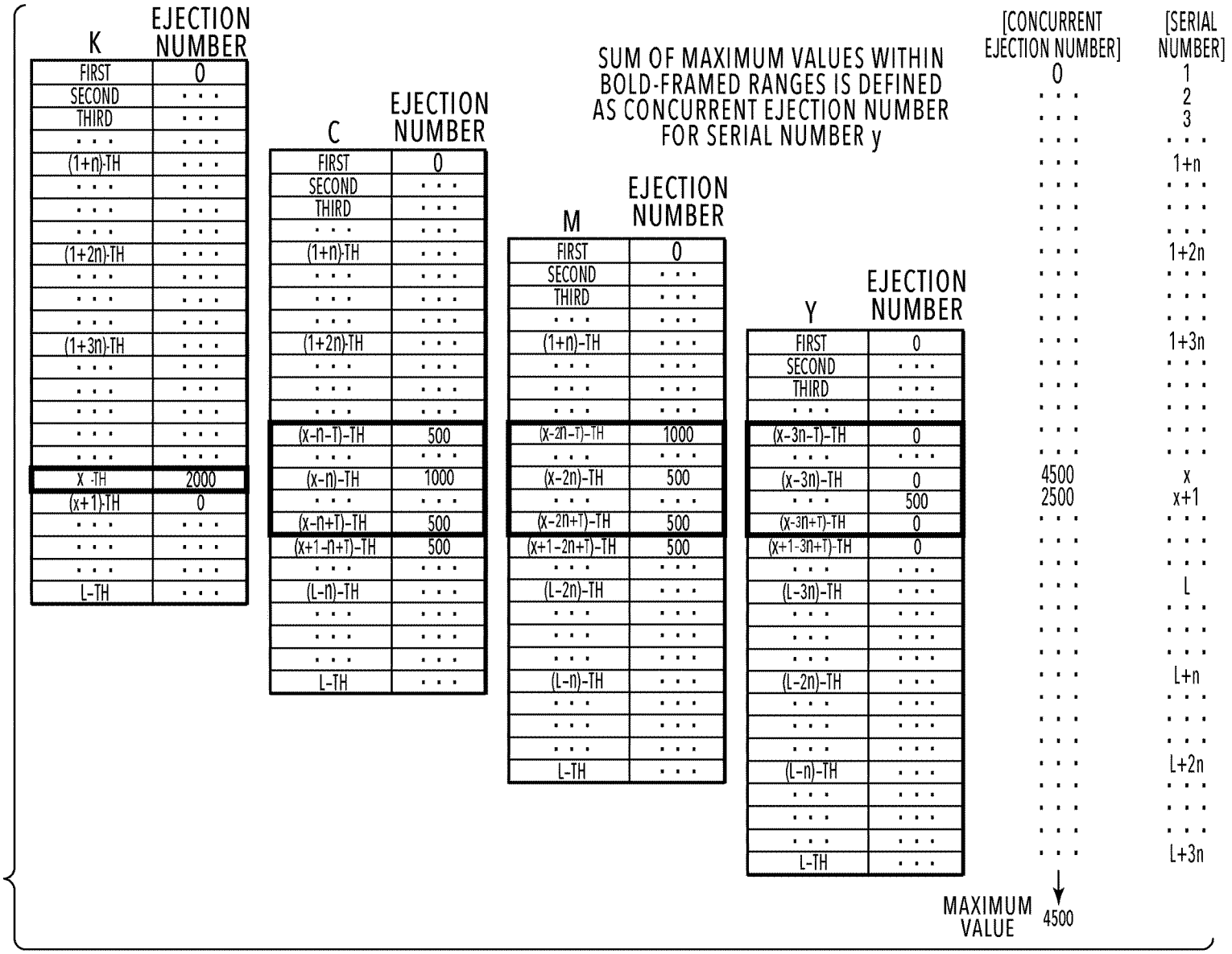
FIG. 17 is an illustration of a method of acquiring a maximum concurrent ejection number.

FIG. 16 is a flowchart showing the details of the maximum concurrent ejection number calculation in step S1303 of FIG. 8. FIG. 17 is an illustration of the maximum concurrent ejection number calculation using the ejection number list. In the following description, it is assumed that the number of rasters in one page (the number of dots in the conveying direction) is L rasters and a standard interval between adjacent print heads converted into the number of dots is n dots (rasters). Further, in reference to the print head 22K, it is assumed that a range in which the ejection timings of the other print heads can be adjusted, that is, a range of rasters for which the amount of displacement in the medium conveying direction should be considered can be set from −T to T (T is a positive integer) one by one.

FIG. 17 shows rasters of K, C, M, and Y shifted vertically by n dots. Rasters of K, C, M, and Y, respectively, shown in the same vertical position in the drawing are rasters for which ejection operation is to be concurrently performed in image data. That is, numbers obtained by subtracting n, 2n, and 3n from the raster number in K correspond to raster numbers in C, M, and Y for which ejection operation is to be concurrently performed, respectively. All the rasters are sequentially numbered one by one from the first raster of K (defined as 1) to the last raster of Y: these numbers are defined as serial numbers. Thus, a serial number at the end of ejection of Y is L+3n.

In FIG. 16, the CPU 220 sets a parameter SyncMax indicating the maximum concurrent ejection number at 0 in step S2101, sets a parameter y indicating the serial number at 1 in step S2102, and advances to step S2103. In step S2103, the CPU 220 sets a parameter SyncX indicating the y-th concurrent ejection number at an ejection number in K corresponding to the serial number y (the x-th ejection number in K). In the example of FIG. 17, the CPU 220 sets SyncX at 2000.

Next, in step S2104, the CPU 220 adds, to SyncX, a maximum concurrent ejection number of C within an adjustable range of the ejection timing adjustment value of C. In the example of FIG. 17, a range of C in which ejection can be performed concurrently with the x-th ejection of K is a bold-framed range from the (x−n−T)-th raster to the (x−n+T)-th raster. The maximum value within this range is 1000 in the (x−n)-th raster. Thus, SyncX=2000+1000=3000. After that, the processing advances to step S2105.

In step S2105, the CPU 220 adds, to SyncX, a maximum concurrent ejection number in M within an adjustable range of the ejection timing adjustment value of M. In the example of FIG. 17, a range of M in which ejection can be performed concurrently with the x-th ejection of K is a bold-framed range from the (x−2n−T)-th raster to the (x−2n+T)-th raster. The maximum value within this range is 1000 in the (x−2n−T)-th raster. Thus, SyncX=3000+1000=4000. After that, the processing advances to step S2106.

In step S2106, the CPU 220 adds, to SyncX, a maximum concurrent ejection number in Y within the entire adjustable range of the ejection timing adjustment value of Y. In the example of FIG. 17, a range of Y in which ejection can be performed concurrently with the x-th ejection of K is a bold-framed range from the (x−3n−T)-th raster to the (x−3n+T)-th raster. The maximum value within this range is 500 between the (x−3n)-th raster and the (x−3n+T)-th raster. Thus, SyncX=4000+500=4500. After that, the processing advances to step S2107.

In step S2107, the CPU 220 determines whether SyncX is greater than SyncMax. If YES, the CPU 220 advances to step S2108, updates SyncMax by substituting the value of SyncX for SyncMax, and then advances to step S2109. If NO, the CPU 220 immediately advances to step S2109.

In step S2109, the CPU 220 determines whether y has reached the maximum serial number L+3n in one image. If NO, the CPU 220 advances to step S2110, add one to y, returns to step S2103, and repeats the subsequent procedure. If YES, the maximum concurrent ejection number calculation is finished.

As described above, in the present embodiment, without acquiring the vertical adjustment value, the inclination adjustment value, or the horizontal adjustment value from the printing apparatus, the maximum possible concurrent ejection number is calculated in consideration of all the ranges of the adjustment values in the host apparatus (printing control apparatus). Accordingly, a time required for starting printing operation after the establishment of communication between the host apparatus and the printing apparatus can be reduced and printing operation can be performed at optimum conveying speed without a shortage of power supply capacity. Further, in a case where the printing system is configured so that a plurality of printing apparatuses are connected to the host apparatus and the same image can be printed, the host apparatus does not need to receive the adjustment values from each printing apparatus, which is advantageous to efficient processing.

5. Others

The present invention is not limited to the embodiment and modifications described above. For example, the present invention can be applied to a printing apparatus and system having printing unit other than inkjet print heads as long as the printing apparatus has a shortage of power supply capacity depending on the maximum concurrent drive number in printing elements. In addition, the number of print heads, colors used for printing, and the order of arrangement can be determined as appropriate. Furthermore, the present invention does not exclude application to a system using a printing apparatus in the form of a serial printer. The application of the present invention is effective as long as a print head is driven concurrently with a scan of a print medium and a shortage of power supply capacity occurs depending on the maximum concurrent drive number of printing elements. As a matter of course, values used in course of calculation such as z, n, and T can be set as appropriate within the range of possibility of registration processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-209645 filed Oct. 30, 2017, and No. 2018-197837 filed Oct. 19, 2018, which are hereby incorporated by reference herein in their entirety.

What is claimed is:

1. A printing system comprising a printing apparatus configured to perform printing on a print medium and a printing control apparatus configured to create image data used for printing by the printing apparatus, wherein the printing apparatus comprises:

(1) a print head in which a plurality of printing elements are arrayed;

(2) a conveying unit configured to convey a print medium to a print area facing the print head in a conveying direction intersecting with an array direction of the printing elements; and (3) a control unit configured to set a conveying speed of the conveying unit, wherein the printing control apparatus comprises an acquisition unit configured to acquire a maximum concurrent drive number in the printing elements based on the image data, an inclination adjustment value used for adjusting an inclination of a print position of the print head with respect to the conveying direction, and a maximum value and minimum value of an array direction adjustment value used for adjusting a print position of the print head in the array direction, and wherein the control unit of the printing apparatus sets the conveying speed of the conveying unit based on the maximum concurrent drive number acquired by the acquisition unit of the printing control apparatus and performs printing based on the image data transmitted from the printing control apparatus.

2. The printing system according to claim 1, wherein the plurality of print heads are arranged in the conveying direction in parallel at specified intervals in the printing apparatus, and wherein the acquisition unit acquires, as the maximum concurrent drive number, the largest concurrent drive number within an adjustable range of print positions of the print heads in the conveying direction.

3. The printing system according to claim 1, wherein the printing control apparatus adds the maximum concurrent drive number to the image data and transmits the maximum concurrent drive number to the printing apparatus, and wherein the control unit of the printing apparatus sets the conveying speed based on the added maximum concurrent drive number.

4. The printing system according to claim 1, wherein the printing control apparatus adds, to the image data, conveying speed data about the conveying unit set based on the maximum concurrent drive number and transmits the conveying speed data to the printing apparatus, and wherein the control unit of the printing apparatus sets the conveying speed based on the conveying speed data.

5. The printing system according to claim 1, wherein the print head has an array of ink ejection openings as the printing elements.

6. The printing system according to claim 1, wherein the printing apparatus adjusts an inclination of a print position of the print head with respect to the conveying direction by changing a timing of printing by the print element depending on a position of the print element in the array.

7. A printing control apparatus for controlling a printing apparatus, the printing apparatus including (a) a print head in which a plurality of printing elements are arrayed, (b) a conveying unit configured to convey a print medium to a print area facing the print head in a conveying direction intersecting with an array direction of the printing elements, and (c) a control unit configured to set a conveying speed of the conveying unit, the printing control apparatus comprising:

an image creating unit configured to create image data to be used for printing by the printing apparatus;

an acquisition unit configured to acquire a maximum concurrent drive number in the printing elements based on the image data, an inclination adjustment value used for adjusting an inclination of a print position of the print head with respect to the conveying direction, and a maximum value and minimum value of an array direction adjustment value used for adjusting a print position of the print head in the array direction; and a transmitting unit configured to transmit data based on the maximum concurrent drive number acquired by the acquisition unit to the control unit.

8. A control method of a printing apparatus, the printing apparatus including a print head in which a plurality of printing elements are arrayed and a conveying unit conveying a print medium to a print area facing the print head in a conveying direction intersecting with an array direction of the printing elements, the control method comprising:

an image data creation step of creating image data used for printing by the printing apparatus;

an acquisition step of acquiring a maximum concurrent drive number in the printing elements based on the image data, an inclination adjustment value used for adjusting an inclination of a print position of the print head with respect to the conveying direction, and a maximum value and minimum value of an array direction adjustment value used for adjusting a print position of the print head in the array direction; and a setting step of setting a conveying speed of the print medium based on the maximum concurrent drive number.

* * * * *